United States Patent [19]

Koeleman et al.

[11] 4,108,658

[45] Aug. 22, 1978

[54] PROCESS FOR DEVELOPING ELECTROSTATIC LATENT IMAGES

[75] Inventors: Gerardus A. J. Koeleman, Velden; Johannes H. A. op de Laak, Blerick, both of Netherlands

[73] Assignee: Océ-van der Grinten N.V., Venlo, Netherlands

[21] Appl. No.: 767,593

[22] Filed: Feb. 10, 1977

Related U.S. Application Data

[60] Continuation of Ser. No. 603,417, Aug. 11, 1975, abandoned, which is a division of Ser. No. 451,254, Mar. 11, 1974, Pat. No. 3,924,567.

[51] Int. Cl.[2] ..... G03G 13/08; G03G 13/09

[52] U.S. Cl. ..... 96/15 D; 427/14; 427/18; 355/3 DD; 118/653; 118/656; 118/657

[58] Field of Search ..... 96/15 D; 427/18, 20, 427/21, 14; 355/3 DD; 118/653, 654, 655, 656, 657, 658

[56] References Cited

U.S. PATENT DOCUMENTS

| | | | |
|---|---|---|---|
| 3,081,737 | 3/1963 | Frantz et al. | 118/652 |
| 3,180,239 | 4/1965 | Shearer et al. | 355/11 |
| 3,333,566 | 8/1967 | Kent | 118/2 |
| 3,572,922 | 3/1971 | Olden | 355/3 DD |
| 3,637,306 | 1/1972 | Cooper | 355/15 |
| 3,641,969 | 2/1972 | Hakanson | 118/3 |
| 3,648,656 | 3/1972 | Ogawa | 118/657 |
| 3,654,902 | 4/1972 | Hakanson | 118/658 |
| 3,659,556 | 5/1972 | Mutschler | 427/14 X |
| 3,697,050 | 10/1972 | Stanley | 259/4 |
| 3,703,395 | 11/1972 | Drexler | 127/18 |
| 3,835,811 | 9/1974 | Yoshio | 118/654 |
| 3,908,595 | 9/1975 | Okada | 118/658 |
| 3,911,864 | 10/1975 | Hudson | 118/648 |
| 3,920,329 | 11/1975 | Dennie et al. | 427/18 X |
| 3,930,466 | 1/1976 | Stover | 427/18 X |
| 3,943,886 | 3/1976 | Vola et al. | 118/657 |
| 3,943,887 | 3/1976 | Smith | 427/14 X |
| 3,981,272 | 9/1976 | Smith et al. | 118/658 |

OTHER PUBLICATIONS

Freeman et al., "Magnetic Brush Unit with Magnetic Conveyor", IBM Tech. Discl. Bull., vol. 15, No. 4, Sep. 1972, pp. 1251–1252.

*Primary Examiner*—Roland E. Martin, Jr.
*Attorney, Agent, or Firm*—Albert C. Johnston

[57] ABSTRACT

A process and apparatus for developing an electrostatic latent image on a surface of a strip-type photoconductor. A working supply of developer material, held readily available for application to the photoconductor, is carried from a holding device to the photoconductor by means of a rotatable applicator. A magnet, magnetically coupled to the applicator, brings the developer material on the applicator into sufficient contact with the photoconductor to cause the developer material to brush the image bearing surface of the photoconductor, thereby developing the latent image on the same. The developer material is collected before being returned to the working supply, and fed to the middle of the working supply to facilitate mixture and blending therewith. In an electrostatic copier, including a replenishing supply of developer material, the above apparatus has provision for mixing replenishing developer material with the developer material collected from the applicator, before feeding the resulting mixture to the working supply.

4 Claims, 4 Drawing Figures

PROCESS FOR DEVELOPING ELECTROSTATIC LATENT IMAGES

This is a continuation, of application Ser. No. 603,417, filed Aug. 11, 1975, now abandoned which is in turn a Division of application Ser. No. 451,254 filed Mar. 11, 1974. The latter application is now U.S. Pat. No. 3,924,567 issued Dec. 9, 1975.

BACKGROUND OF THE INVENTION

Electrostatic copying machines of the type which utilize strip-type photoconductors, including a surface adapted to carry a developable electrostatic latent image, generally utilize dry developer materials for developing the latent image. Such developer materials normally include a toner material and a carrier material. For development purposes, the toner material is charged to a polarity opposite to that of the charge forming the latent image on the photoconductor. As a consequence, when the developer material is brought into contact with the image bearing surface of the photoconductor, toner material adheres to the image, thereby rendering the same visible, i.e., developed. Accordingly, copying machines of the aforesaid type are generally provided with some means for contacting the image bearing surface of the photoconductor with developer material from a readily available working supply of the same.

One of the known types of apparatus available for developing latent images is a magnetic-brush developer. For use with such developers, the carrier material content of the developer material is made of a magnetizable material, such as iron. A typical magnetic-brush developer includes a rotating applicator immersed in a working supply of developer material, and a moving magnet cooperative with the applicator for forming a magnetic field in a space between the applicator and magnet. Since pa photoconductor bearing the electrostatic latent image is also disposed in the field space, with the image surface facing the applicator; as the applicator urges developer material into the field space the field entrains the developer material disposed on the surface of the applicator. As applicator and magnet move in different directions relative to one another, the entrained developer material brushes the image bearing surface of the photoconductor, thereby developing the latent image. The developer material on the applicator is then returned directly to the working supply of developer material, mixed with the same and recycled.

To prevent the working supply of developer material from becoming gradually useless due to wear and tear of the carrier material content and continuous dissipation of the toner material content, the supply must be rejuvenated from time-to-time. This is normally done by adding developer material, including toner and/or carrier material, from a replenishing supply of the same, directly into the working supply of developer material and mixing the added material with the working supply along with the developer material returned to the working supply from the applicator.

In such systems the developer material returned to the working supply from the applicator is often insufficiently mixed with the working supply before being recycled for development purposes, and/or the developer material from the replenishing supply is insufficiently mixed with the working supply before being initially utilized. As a result, a given portion of an electrostatic latent image may be under-developed, over-developed or not developed; or a particular developed image, and/or successive developed images, may be unevenly shaded with toner material. Accordingly:

An object of the present invention is to provide an electrostatic copier including improved means for developing electrostatic latent images;

Another object is to provide improved apparatus for developing electrostatic latent images including means for collecting and mixing developer material;

A further object is to provide improved means for holding, carrying, collecting, feeding and blending developer materials in an electrostatic copier; to ensure having a uniformly bblended working supply of developer material available for developing electrostatic latent images; and A still further object is to provide a process for developing electrostatic latent images including an improved method of mixing developer materials utilized in the process.

SUMMARY OF THE INVENTION

The invention is directed to a process and apparatus for developing an electrostatic latent image on a strip-type photoconductor. The apparatus includes means for holding a working supply of developer material readily available for application to the photoconductor. An applicator adapted to carry developer material from the working supply to the photoconductor cooperates with magnetic means for bringing the carried developer material into sufficient contact with the photoconductor to brush the same for developing the image thereon. The apparatus also includes means for collecting the developer material carried by the applicator and feeding the same to substantially the middle of the working supply of developer material, to promote completely blending the collected developer material with the working supply. In an electrostatic copier the invention includes a process and apparatus for mixing developer material from a replenishing supply thereof with the developer material collected from the applicator, before feeding the resulting mixture to the holding means for further mixture and blending with the working supply of developer material.

BRIEF DESCRIPTION OF THE DRAWINGS

As shown in the drawings, wherein like reference numerals designate like or corresponding parts throughout the several Figures.

DESCRIPTION OF THE PREFERRED EMBODIMENT

Figure 1:
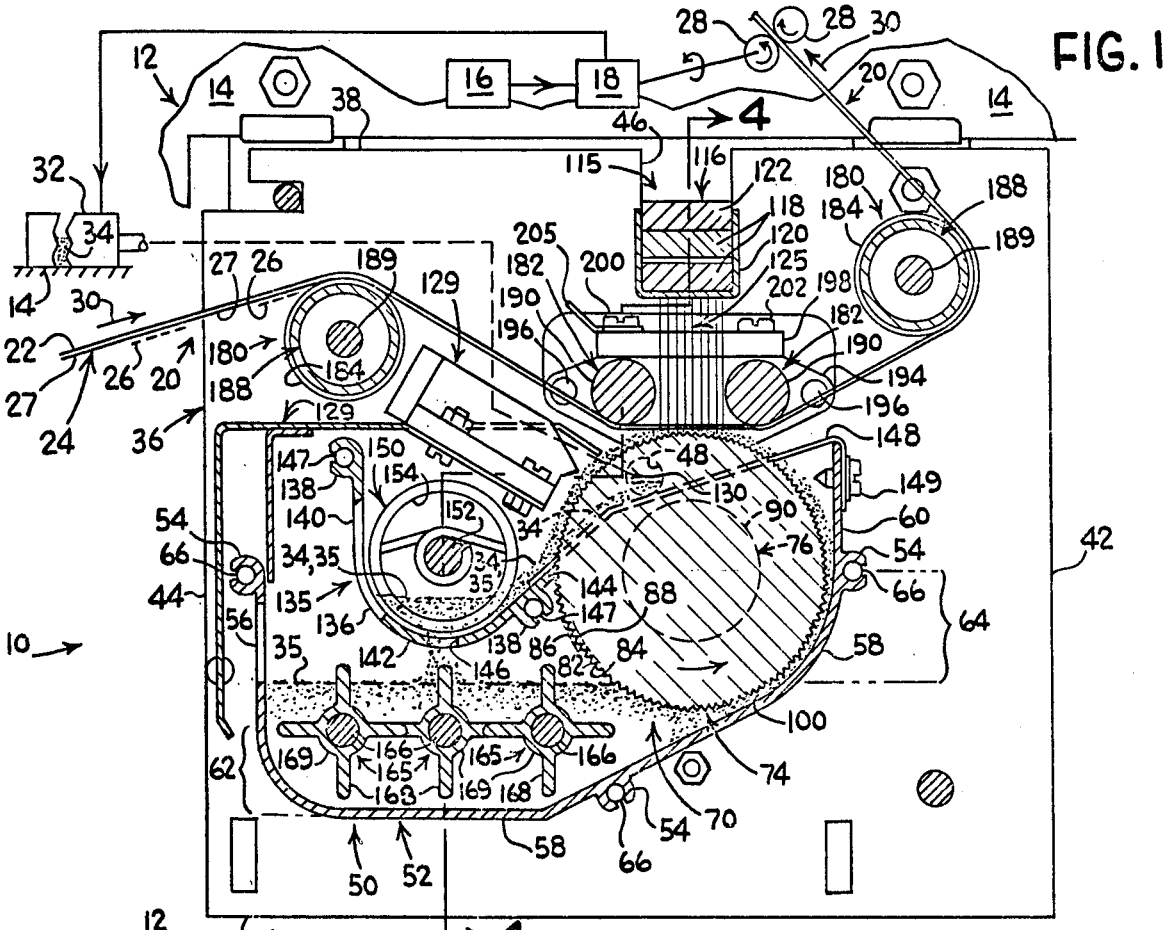
FIG. 1 is a fragmentary cross-sectional view, in elevation, of a typical electrostatic copier including magnetic-brush assembly according to the invention, taken substantially along the line 1—1 of FIG. 3; and a schematic showing of relevant means in the copier which typically cooperates with the assembly for developing electrostatic latent images on a strip-type photoconductor.

As shown in FIG. 1, a magnetic-brush assembly 10, according to the invention, is disposed in an electrostatic copier 12. The copier 12 includes suitable framework 14, a source of supply of electrical power 16 and motorized driving means 18. The source 16 and driving means 18 are suitably supported by the framework 14 and coupled to one another for energizing the driving means 18. In addition, the copier 12 includes a strip-type photoconductor 20 having an upper surface 22 and a lower surface 24. The lower surface 24 is adapted to carry electrostatic charges, for forming a developable electrostatic latent image 26 defining a non-image bearing area 27 of the lower surface 24. Further, the copier 12 includes a pair of rollers 28 which are suitably connected to the driving means 18 for rotation. The rotating rollers 28 are disposed in engagement with the photoconductor 20 for moving the same in a predetermined path of travel 30. The copier 12 further includes a suitable dispenser 32 for carrying a replenishing supply of developer material 34. The dispenser 32 is suitably supported by the framework 14, and coupled to the driving means 18 for discharging the developer material 34. The electrostatic latent image 26 is developed in place on the moving photoconductor 20 by contacting the photoconductor's lower surface 24 and thus the latent image 26 with a working supply of developer material 35 within the assembly 10.

Figure 2:
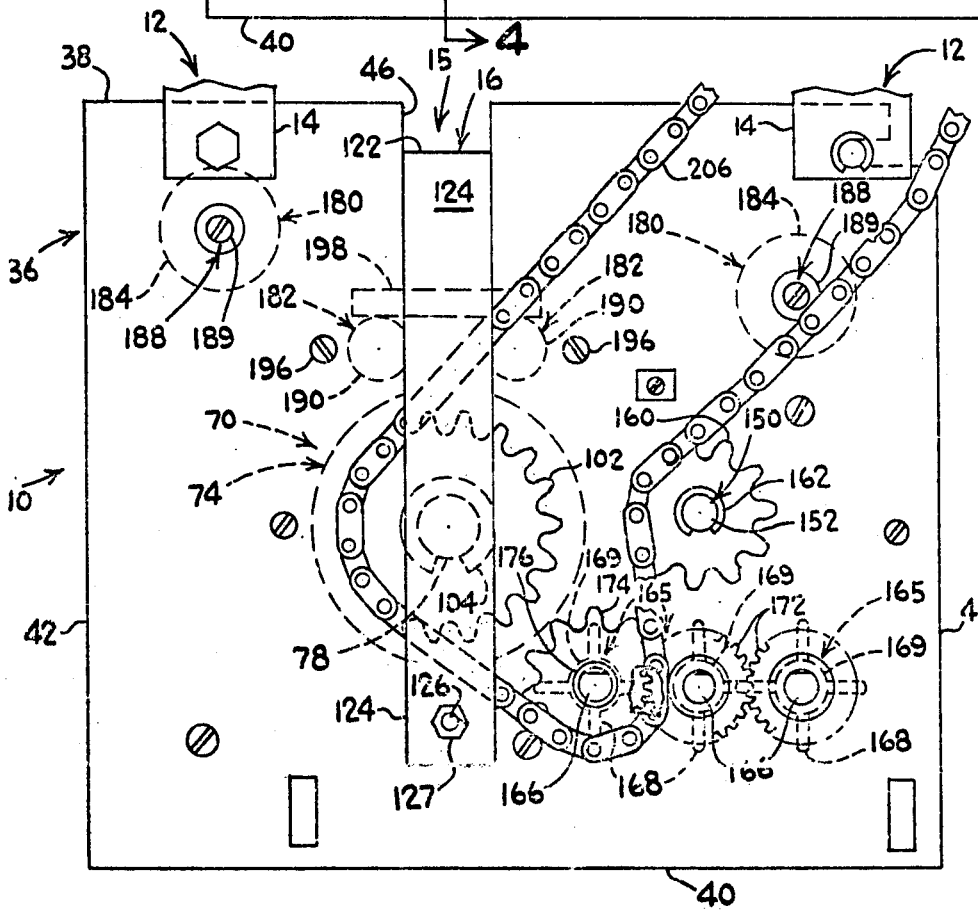
FIG. 2 is a fragmentary left side view, in elevation, of the assembly of FIG. 3, showing one of the assembly supporting plates and the driven gear system, together with driving means typically found in an electrostatic copier.

The assembly 10 includes a pair of oppositely-facing, rectangularly-shaped plates 36, one of which is shown in FIG. 2, for supporting the assembly 10 within the copier 12. Each of the supporting plates 36 has an upper edge 38, a lower edge 40, a front edge 42 and a rear edge 44. In addition, each of the plates 36 has a downwardly-extending, U-shaped slot 46, located in the upper edge 38, and, at least one of the plates 36 (FIG. 1) has a circularly-shaped aperture 48.

To hold the working supply of developer material 35 (FIG. 1) readily available for application to the electrostatic latent image 26, the assembly 10 includes an elongated pan 50. The pan 50 includes an elongated, open-ended, U-shaped body portion 52. The body portion 52 is made of a non-magnetic material and includes a plurality of longitudinally-extending, externally-projecting lugs 54. In addition, the body portion 52 has a rear wall 56, a curved base wall 58 and a front wall 60. The rear wall 56 extends vertically-downwardly to the base wall 58. The base wall 58 initially curves downwardly and forwardly through an arcuate portion 62 of approximately 90°; then extends directly horizontally-forwardly; then directly upwardly and forwardly, at an angle of approximately 45° from the horizontal; and then curves forwardly and upwardly through an arcuate portion 64 of approximately 45°. The front wall 60 extends directly vertically-upwardly from the base wall 58. In addition, the pan 50 includes oppositely disposed side walls (not numbered) formed by the assembly supporting plates 36.

For locating the body portion 52 between the supporting plates 36, the assembly 10 includes a plurality of elongated tie rods 66. The tie rods 66 are bracketed by the lugs 54 to vertically support the weight of the pan's body portion 52. In addition, the tie rods 66 are fixedly secured to the plates 36, to hold the plates 36 and thus the pan's side walls (not numbered) in abutment with the body portion 52.

Figure 3:
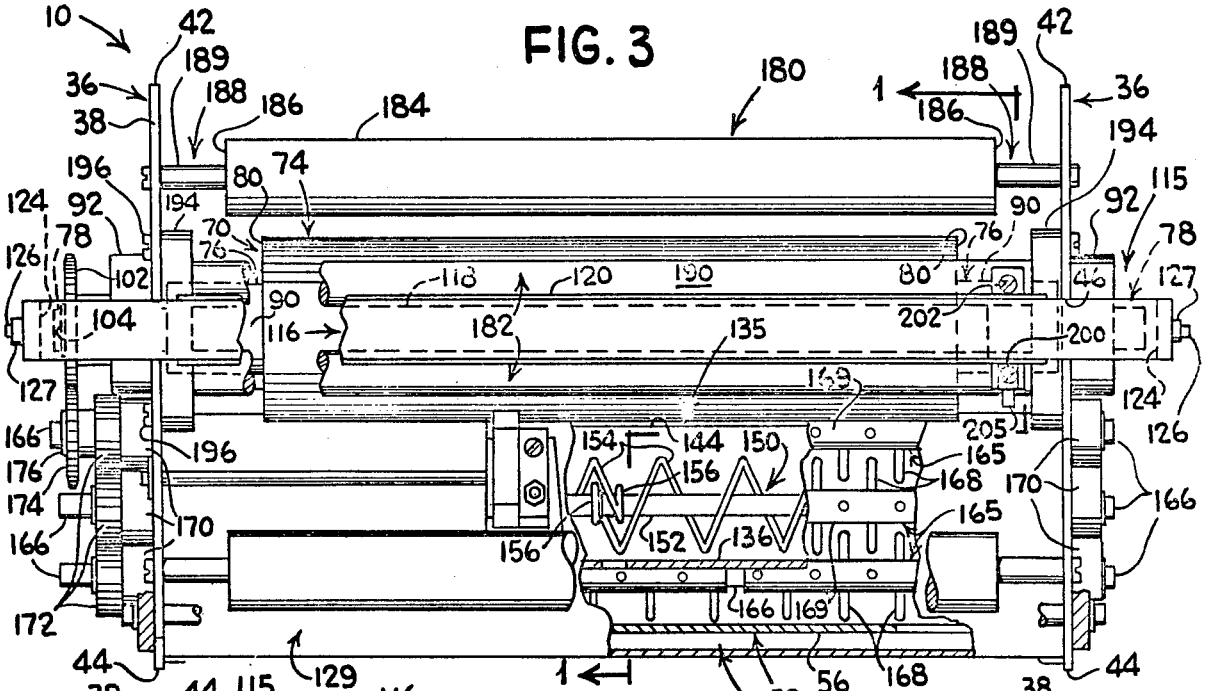
FIG. 3 is a fragmentary, top plan view of the magnetic-brush assembly according to the invention, showing the details of construction of various means for holding, carrying, collecting, mixing, blending and feeding developer materials in the assembly.

To upwardly carry the working supply of developer material 35 (FIG. 1) from the pan 50 to the moving photoconductor 20, for developing the electrostatic latent image 26, the assembly 10 includes a rotatable applicator 70. The applicator 70 (FIGS. 3 and 4) is a roller made of a magnetizable material and has a mid-portion 74, a pair of oppositely-extending shoulder portions 76 and a pair of oppositely-extending stub portions 78. The mid-portion 74 (FIG. 1), which is generally circular in transverse cross-section, has opposite end surfaces 80 and a plurality of parallel, longitudinally-extending, alternate ridges 82 and grooves 84. The ridges 82 and grooves 84 provide the mid-portion 74 with a circumferentially-extending, corrugated outer surface (not numbered). In addition, the ridges 82 of the rotating applicator 70 define a virtual outer surface of revolution 86, whereas the grooves 84 define a virtual inner surface of revolution 88. The shoulder portions 76 each have a cylindrically-shaped outer surface 90, and extend longitudinally in opposite directions from the respective mid-portion end surfaces 80 (FIG. 3). And, the stub portions 78 extend longitudinally in opposite directions from the respective shoulder portions 76.

To rotatably support the applicator 70 (FIG. 3), the assembly 10 includes a pair of bearing means 92 suitably attached to the opposite assembly supporting plates 36 and to the opposite applicator stub portions 78. As thus supported, the applicator mid-portion 74 and shoulder portions 76 extend transversely between the assembly plates 36, and the stub portions 78 extend in opposite directions through the plates 36 and the attached bearing means 92. In addition, the applicator's inner and outer surfaces of revolution, 88 and 86 (FIG. 1), extend transverse to the path of travel 30 of the moving photoconductor 20, and extend adjacent and parallel to the pan base wall 58 in the area where the base wall 58 curves through the 45° arcuate portion 64. Since the radius of curvature of the applicator's outer surface of revolution 86 is slightly less than that of the pan's arcuate portion 64, as measured from the axis of the applicator 70 the surface 86 and wall 58 define a narrow, arcuately-shaped space 100 between the applicator 70 and pan 50. As shown in FIG. 2, to rotate the applicator 70, the assembly 10 includes a driven sprocket gear 102 suitably fixedly attached to the applicator stud portion 78, as by means of a retaining clip 104.

With the applicator 70 (FIG. 1) thus supported for rotation, the applicator mid-portion 74 is immersed in the working supply of developer material 35 within the pan 50. As the applicator 70 rotates, the developer material 35 is carried forwardly within the pan 50, where it tends to be wedged by the rotating applicator 70 into the arcuate space 100 between the applicator 70 and pan 50, causing the developer material 35 to longitudinally spread across the surface of the applicator 70; and to then be carried counter-clockwise, forwardly and upwardly within the space 100, and thus toward the photoconductor 20. As the developer material 35 is upwardly carried above the level of the applicator's axis (not numbered), the spaces between the applicator's surfaces of revolution, 86 and 88, become filled with developer material 35.

For contacting the electrostatic latent image 26 with the developer material 35 carried to the photoconductor 20 by the applicator 70, the assembly 10 includes magnetic means 115 (FIG. 4) magnetically coupled to the applicator 70. The magnetic means 115 includes an inverted U-shaped bracket 116, an elongated bar magnet 118 and an elongated channel member 120. The bracket 116 is made of a strip of magnetizable material and includes a base leg 122 and opposed, downwardly-extending side legs 124. The bar magnet 118 is made of a permanently magnetized material which is rectangularly-shaped in transverse cross-section and magnetically polarized transverse to its longitudinal length, to provide a magnetic field 125 (FIG. 1) between the magnet 118 and applicator mid-portion 70. The channel member 120, which is made of a non-magnetic material and is U-shaped in transverse cross-section, acts as a housing for the magnet 118. The magnet 118 is fixedly secured to the channel member 120, which is in turn fixedly secured to the base leg 122 of the bracket 116 so as to lengthwise dispose the magnet 118 in intimate parallel contact with the base leg 122. To properly locate the magnetic means 115 relative to the rotating applicator 70, the bracket's base leg 122 is located directly above the axis of the applicator 70 in the opposed plate slots 46 (FIG. 4), with both the magnet 118 and channel member 120 longitudinally-extending between the assembly plates 36. As thus disposed, the magnet 115 extends lengthwise parallel to and substantially in registry with the applicator mid-portion 74, and the bracket side legs 124 are located outside of the assembly plates 36. To secure the magnetic means 115 to the plates 36, the bracket side legs 124 are adjustably attached to the opposite assembly plates 36. To that end, the assembly 10 includes a pair of elongated standoffs 126, made of a non-magnetic material, which extend through the opposite bracket legs 124 and are fixedly secured to the adjacently-disposed plates 36; and a plurality of adjustable fasteners 127. The fasteners 127 are movable, lengthwise of the stand-offs 126, and lockable in place on the same for adjustably locating the side legs 124 in suitably close proximity to the oppositely extending applicator stub portions 78 so as to complete the magnetic field generated by the bar magnet 115 through the base leg 122, side legs 124 and applicator 70.

As shown in FIG. 1, the magnet 118 attracts the carrier material content of the developer material 35 on the rotating applicator 70 toward the magnet 118. As a consequence, the developer material 35 is entrained by the magnetic field 125 to form a brush-like conglomeration of developer material 35 in the space between the magnet 118 and the applicator 70, for brushing the suitably charged toner material content of the developer material 35 against the lower surface 24 of the intervening moving photoconductor 20; as a result of which the electrostatic latent image 26 is rendered visible. Thus, the magnetic means 115 and applicator 70 cooperate with one another to develop a suitable magnetic field 125 between the magnet 115 and applicator 70 to permit developer material 35 on applicator 70 to be brushed against the moving photoconductor 20 for developing the electrostatic latent image 26 on the same.

Since the electrostatic latent image 26 is normally provided by means of a process including the steps of intially depositing electrostatic charges of a given polarity on the lower surface 24 of the moving photoconductor 20 and then removing charges, other than the image forming charges, from the lower surface 24; the non-image bearing area 27 of the photoconductor's lower surface 24 usually has deposited on the same a distributed net charge of the same polarity as the charges forming the electrostatic latent image 26. To prevent the development of such non-image forming charges, the applicator 70 is electrically connected by suitable means to the power source 16, to hold the applicator 70 at a suitable current conducting and/or voltage level for suppressing the development of charges on the non-image bearing area 27 of the photoconductor's lower surface 24, but permitting the development of the electrostatically formed image 26.

Since the working developer material 35 (FIG. 1) requires a rejuvenation from time-to-time to increase the carrier and/or toner material content of the same, the assembly 10 includes a device 128 which is responsive to a selected condition of the developer material 35 on the applicator 70 for actuating the driving means 18; to discharge the dispenser 32 at a suitable rate for adding developer material 34 to the working supply of developer material 35 within the pan 50. The assembly 10 also includes a supporting plate 129 for mounting the condition responsive device 128 in suitably close proximity to the applicator 70 for sensing the selected condition of the developer material 35. With this arrangement, the replenishing supply of developer material 34 in the dispenser 32 is normally discharged into the assembly 10 from time-to-time via the plate opening 48, as indicated by the arrow 130.

To ensure having a working supply of developer material 35 of uniform consistency, the assembly 10 includes an elongated hopper 135 which the developer material 35 from the applicator 70 is collected after being brushed against the photoconductor 20. The hopper 135 (FIG. 1) includes an elongated open-ended, curved body portion 136 made of a non-magnetic material. The body portion 136 includes a plurality of longitudinally-projecting lugs 138, and has a rear wall 140 and a curved base wall 142. The rear wall 140 extends vertically-downwardly to the base wall 142 from a level above that of the axis of the applicator 70 to approximately the same level. The base wall 142, which has a forwardly-extending leading edge 144 and a substantially centrally disposed aperture 146, initially curves downwardly and forwardly, and then upwardly, through an arc of approximately 135°; and then extends directly upwardly and forwardly at an angle of approximately 45°, to a level which is approximately the same as that of the axis of the applicator 70. In addition, the hopper 135 includes oppositely disposed side walls (not numbered) formed by the assembly supporting plates 36.

For locating the hopper body portion 136 (FIG. 1) partially within the pan 50 and between the assembly supporting plates 36, the assembly 10 includes a plurality of elongated tie rods 147. The tie rods 147 are bracketed by the body portion lugs 138 to vertically support the weight of the body portion 136, and are fixedly secured to the assembly plates 36 to hold the plates 36 and thus the hopper's side walls (not numbered) in abutment with the body portion 136. Since the hopper's forward edge 144 is located adjacent and parallel to the outer surface of revolution 86 of the rotating applicator 70, developer material 35 from the rotating applicator 70 falls under the influence of gravity into the hopper 135, rather than into the pan 50.

To guide replenishing developer material 34 into the hopper 135, from the assembly plate opening 48, the assembly 10 includes an elongated guide plate 148. The guide plate 148 is made of a non-magnetic material which is fixedly secured to the pan's front wall 60 by one or more fasteners 149. The plate 148 extends angularly rearwardly and downwardly from the pan's front wall 60 for disposition adjacent to and beneath the assembly plate aperture 48; and then extends further angularly rearwardly and downwardly for disposition rearwardly beyond and above the hopper's forwardly extending leading edge 144, and in contact with the hopper base wall 142. As thus secured, the guide plate 148 is disposed to receive the replenishing developer material 34 falling under the influence of graivty from the plate aperture 48, and acts as a ramp for guiding the same into the hopper 135 for collection therein and mixture with the working supply of developer material 35 from the applicator 70.

To feed the working developer material 35 from the applicator 70 to the aperture 146 and mix the replenishing and working supplies of developer material, 34 and 35, in the hopper 135; the assembly 10 includes feeding type of mixer 150. The mixer 150 has a rotatable shaft 152 and a pair of spiral members 154, both of which are made of non-magnetic materials. The shaft 152 (FIG. 4) has a longitudinally-extending axis (not numbered), and the spiral members 154 are elongated, circularly-helically coiled members including opposite end portions 156. The spiral members 154 are longitudinally axially aligned with one another on the shaft 152 so as to slightly overlap one another near the middle of the shaft 152, coil in opposite directions around the shaft 152, and longitudinally-extennd in opposite directions lengthwise of the shaft from the overlapping end portions 156. As thus aligned the end portions 156 of the spiral members 154 are suitably fixedly attached to the shaft 152 for rotation, with the overlapping end portions 156 disposed on opposite sides of the hopper aperture 146.

To rotatably support the mixer 150 (FIG. 4) the assembly 10 includes a pair bearing means 158 suitably attached to the opposite assembly plates 36 and to the ends of the mixer shaft 152. As thus supported, the spiral members 154 longitudinally extend transversely between the assembly plates 36, and the shaft 152 extends in opposite directions through the assembly plates 36 and attached bearing means 158. In addition, the spiral members 154 are disposed within and in close proximity to, but out of contact with, the hopper body portion 136. To rotate the mixer 150 the assembly 10 includes a driven sprocket gear 160 suitably fixedly attached to the mixer shaft 152, as by means of a retaining clip 162.

With the mixer 150 thus supported for rotation, the spiral members 154 (FIG. 1) are immersed in both the replenishing and working supplies of developer material 34 and 35 within the hopper 135. As the mixer 150 rotates the developer materials, 34 and 35, are mixed with one another by the spiral members 154 while being simultaneously fed by the same to the centrally disposed hopper aperture 146. Whereupon, the mixed developer materials, 34 and 35, fall under the influence of gravity into the pan 50. The developer material 35 from the applicator 70, either alone or mixed with developer material 34 from the replenishing supply 32, when the dispenser 32 has been actuated, is thus fed to substantially the middle of the working supply of developer material 35 within the pan 50. This arrangement tends to compensate for the natural tendency of the rotating applicator 70 to distribute the working developer material 35 toward the opposite side walls (not numbered) of the pan 50, and cause the working supply of developer material 35 to develop circulatory flow paths extending lengthwise of the applicator 70 and pan 50. As a consequence, of routing the developer material 35 from the applicator 70 through the hopper 135, it is more uniformly mixed with the working and/or replenishing supplies of developer materials, 34 and 35 than it would be if allowed to fall directly into the pan 50 from the applicator 70.

To blend the replenishing and working supplies of developer material, 34 and 35, and feed the resulting blend 35 forwardly within the hopper 135 to the applicator 70, the assembly 10 includes a plurality of rotatable agitators 165 (FIG. 1), preferably three in number. Each of the agitators 165 is made of a non-magnetic material and includes an elongated shaft 166, having a longitudinally-extending axis (not numbered), and a plurality of outwardly, radially-extending spokes 168. The spokes 168 (FIG. 3) extend from tubular hubs 169 fixedly secured to the shaft 166. The shafts 166 are located at suitably longitudinally and circumferentially spaced intervals lengthwise of each of the shafts 166, such that the spokes 168 of adjacent agitators 165 are located at alternate intervals lengthwise of the shafts 166.

To rotatably support the agitators 165, the assembly 10 includes a pair of bearing means 170 (FIG. 3) for each of the agitators 165. The bearing means 170 are suitably attached to the opposite assembly plates 36 and to the opposite ends (not numbered) of the respective shafts 166. As thus supported, the shafts 166 extends transversely between the assembly plates 36 and in opposite directions through the plates 36 and attached bearing means 170. In addition, the shaft spokes 168 (FIG. 1) are disposed within and in close proximity to, but out of contact with, the pan base wall 52. And, the spokes 168 of the next adjacent agitators 165 are disposed for rotation in interleaving paths of travel relative to one another within the pan 50. To rotate the agitators 165 the assembly 10 includes a plurality of intermeshing gears 172 (FIG. 3) each of which is suitably fixedly secured to one of the agitator shafts 166, and a driven sprocket gear 174 suitably fixedly secured to one of the agitator shafts 166 as by means of a retaining clip 176.

With the agitators 165 thus supported for rotation, the spokes 168 (FIG. 1) are immersed in the working supply of developer material 35 within the pan 50. Preferably, the sprocket gear 174 rotates the agitator shaft 166 next adjacent to the applicator 70 in the same direction as that of the applicator 70, so as to feed the developer material beneath the applicator 70 into the space 100 between the applicator 70 and pan 50. On the other hand, the agitator 165 disposed directly beneath the pan opening 146 is preferably rotated in the opposite direction, so as to cause the mixed developer materials, 34 and 35, from the hopper 135 to be for the most part rearwardly directed within the pan 50, for further mixture with one another and blending with the pan's working supply of developer material 35.

To guide the moving photoconductor 20 (FIG. 1) in the predetermined path of travel 30 toward, between and then away from the magnetic means 115 and applicator 70, the assembly 10 includes a pair of elongated rotatable tubular rollers 180 and a pair of elongated non-rotatable shafts 182.

Figure 4:
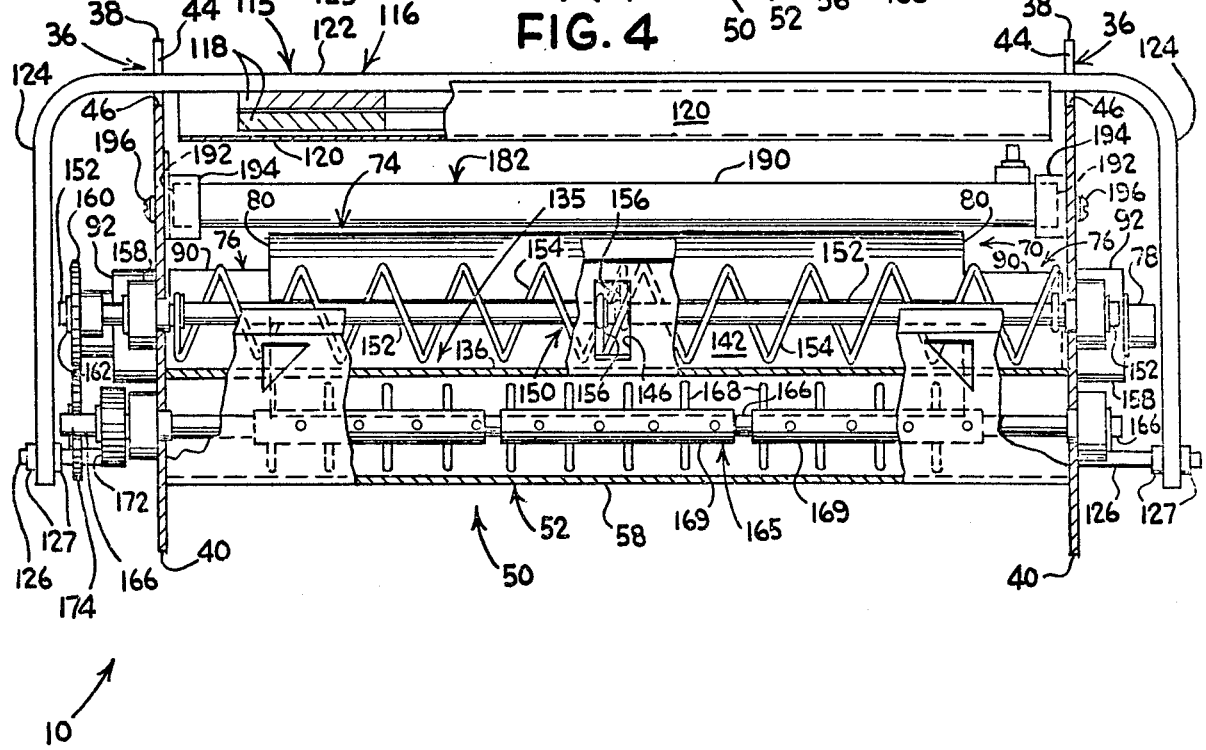
FIG. 4 is a fragmentary rear view, in elevation, of the magnetic-brush assembly, taken substantially along the line 4—4 of FIG. 1, showing further details of the construction of the assembly according to the invention.

Each of the rollers 180 (FIG. 3) is a tube made of an electrically non-conductive, non-magnetic material and has a cylindrically-shaped outer surface 184 and opposite ends 186. To support the rollers 180 for rotation between the plates 36, the assembly 10 includes bearing means 188 suitably attached to each of the tube ends 186 (FIG. 4). The bearing means 188 each include a stub shaft 189. The stud shafts 189 extend in opposite directions from the opposite tube ends 186 and are suitably fixedly secured to the adjacent assembly supporting plates 36.

As thus disposed, the rollers 180 extend transversely between the plates 36, parallel to one another and to the applicator 70, and transverse to the path of travel 30 (FIG. 1) of the moving photoconductor 20. As shown in FIG. 1, the outer surfaces 184 of the rollers 180 are engaged by the moving photoconductor 20 for guiding the same toward and away from the non-rotatable shafts 182 and thus the rotating applicator 70.

Each of the non-rotatable shafts 182 (FIG. 1) is made of an electrically conductive, non-magnetic material and has a cylindrically-shaped outer surface 190 and opposite ends 192 (FIG. 4). To support the shafts 182, the assembly 10 includes a pair of yoke-like members 194 at each end 192 of the respective shafts 182. The yoke-like members 194 (FIG. 1) are made of an electrically insulating material adapted to embrace the adjacent shafts 182 and electrically insulate the same from the adjacent assembly supporting plates 36, to which the members 194 are suitably fixedly secured as by means of fasteners 196. To prevent rotation of the shafts 182, the assembly 10 includes a strap 198 located adjacent to each of the yoke members 194. The straps 198, which are made of an electrically insulating material, each span the adjacent shafts 182 and are fixedly secured to the same by means of fasteners 200 and 202.

As thus disposed the shafts 182 (FIG. 4) extend transversely between the plates 36, parallel to one another and to the applicator 70, and transverse to the path of travel 30 (FIG. 1) of the moving photoconductor 20. As shown in FIG. 1, the outer surfaces 190 of the respective shafts 182 are engaged by the moving photoconductor 20 and act as bearing surfaces for guiding the moving photoconductor 20 between the magnetic means 115 and applicator 70 so as to permit the working developer material 35 on the applicator 70 to contact the photoconductor's image bearing lower surface 24. The straps 198 rigidly anchor the shafts 182 to one another to hold the same against rotation by the moving photoconductor 20. Preferably, at least the fasteners 200 are made of an electrical current conducting material, suitably connected, as by conducting means 205, to the power supply 16 for neutralizing the voltage level of the non-image bearing upper surface 22 of the moving photoconductor 20.

As shown in FIG. 2, to drive the applicator 70, mixer 150 and agitator 165; the assembly 10 includes a sprocket chain 206 looped around and disposed in engagement with the sprocket gears 102, 160 and 174. The chain 206 is connected by suitable means (not shown) to the motorized driving means 18 for rotating the gears 102, 160 and 174 and thus the applicator 70, mixing 150 and agitators 165.

In accordance with the objects of the invention there has been described an improved process and apparatus for developing an electrostatic latent image on a surface of a photoconductor. The apparatus includes means for holding, carrying, collecting, feeding and blending developer material to ensure having a uniformly blended supply of developer material readily available for the development of latent images; whereas the process includes steps performed, for example, by the improved apparatus.

Inasmuch as certain changes may be made in the above described invention without departing from the spirit and scope of the same, it is intended that all matter contained in the above description or shown in the accompanying drawings shall be interpreted in an illustrative rather than limiting sense. And, it is intended that the following claims be interpreted to cover all the generic and specific features of the invention herein described.

What is claimed is:

1. In a copier including a photoconductor movable in a predetermined path of travel, means for holding a working supply of developer material, a replenishing supply of developer material, means for collecting developer material including an elongated hopper longitudinally extending transverse to said predetermined path of travel, said hopper including a base wall having a centrally disposed aperture, and means for mixing developer material, a process for developing an electrostatic latent image on the photoconductor, said process comprising:

a. moving the photoconductor in said predetermined path of travel;
b. upwardly carrying working developer material from said holding means to said moving photoconductor;
c. contacting the moving photoconductor with carried developer material;
d. collecting the carried developer material in said hopper after the contacting step;
e. adding replenishing developer material to said hopper;
f. mixing the developer material in said hopper; and
g. feeding the developer material in said hopper to said centrally disposed aperture for discharge therethrough to said holding means.

2. The process according to claim 1 including the step of permitting the carried developer material to fall into said hopper.

3. The process according to claim 1 including the step of permitting the fed developer material to fall through said aperture into substantially the middle of said holding means.

4. The process according to claim 1 including the step of mixing the developer material in said holding means.

* * * * *